US006708852B2

(12) United States Patent
Blake

(10) Patent No.: US 6,708,852 B2
(45) Date of Patent: Mar. 23, 2004

(54) NON-CHEMICAL AEROSOL DISPENSER

(75) Inventor: William S. Blake, Linwood, NJ (US)

(73) Assignee: Alternative Packaging Solutions, L.P., Lake St. Louis, MO (US)

( * ) Notice: Subject to any disclaimer, the term of this patent is extended or adjusted under 35 U.S.C. 154(b) by 0 days.

(21) Appl. No.: 09/933,574

(22) Filed: Aug. 20, 2001

(65) Prior Publication Data

US 2003/0034362 A1 Feb. 20, 2003

(51) Int. Cl.[7] ..... B65D 88/54

(52) U.S. Cl. ..... 222/321.5; 222/321.8; 222/321.9; 222/377; 222/383.2; 222/207

(58) Field of Search ..... 222/321.8, 321.9, 222/207, 209, 377, 379, 380, 383.2, 321.5, 321.7, 153.13

(56) References Cited

U.S. PATENT DOCUMENTS

| | | | | |
|---|---|---|---|---|
| 4,147,280 A | | 4/1979 | Spatz | 222/179.5 |
| 4,167,941 A | | 9/1979 | Capra et al. | 128/251 |
| 4,174,052 A | | 11/1979 | Capra et al. | 222/207 |
| 4,174,055 A | | 11/1979 | Capra et al. | 222/319 |
| 4,222,500 A | | 9/1980 | Capra et al. | 222/207 |
| 4,387,833 A | | 6/1983 | Venus, Jr. | 222/95 |
| 4,423,829 A | | 1/1984 | Katz | 222/95 |
| 4,872,595 A | | 10/1989 | Hammett et al. | 222/209 |
| 5,183,185 A | | 2/1993 | Hutcheson et al. | 222/209 |
| 5,549,223 A | * | 8/1996 | Hori | 222/153.13 |

FOREIGN PATENT DOCUMENTS

| | | | |
|---|---|---|---|
| GB | 2005344 A | 4/1979 | F04B/43/08 |

* cited by examiner

*Primary Examiner*—Kevin Shaver
*Assistant Examiner*—Stephanie L. Willatt
(74) *Attorney, Agent, or Firm*—Santangelo Law Offices, P.C.; Chad Soliz

(57) ABSTRACT

A mechanically pressurized aerosol dispensing system comprising a cap which houses a piston, an actuator moveably attached to the cap, forming together with the cap a dispensing head assembly, and an expandable elastic reservoir. The system is fitted over a standard container holding a liquid product, and includes a dip tube assembly to draw liquid into the dispensing head assembly, where the contents are released through the dispensing head assembly, via the aerosol nozzle and valve. A twist of the threaded cap raises a piston, thereby opening a charging chamber within the dispensing head assembly. This creates a vacuum with the resulting suction pulling the product up through the dip tube to fill the charging chamber. Twisting the cap in the opposite direction lowers the piston in a downstroke which closes the charging chamber, forcing the product into the expandable elastic reservoir where it is then discharged through the nozzle.

52 Claims, 14 Drawing Sheets

NON-CHEMICAL AEROSOL DISPENSER

BACKGROUND OF INVENTION

1. Field of Invention

The present invention relates to dispensers generally, and more specifically, to aerosol dispensers that are pressurized by mechanical energy instead of chemical energy.

2. Description of the Related Art

Aerosol dispensers have been in use for more than fifty years, and continue to gain in popularity because of the convenience of their use. However, many of those dispensers rely upon chemical propellants, including chlorofluorocarbons and hydrocarbon compounds to pressurize the product. The use of chemical pressurizing agents creates special problems, including safety concerns in filling, shipping, handling, storing, using and disposing the pressurized, and often flammable containers. Another set of concerns involves questions relating to the effect of certain pressurizing chemical agents upon the earth's ecosystem, including particular questions concerning their effect on the ozone layer, and questions concerning the effect of the release of volatile organic compounds into the atmosphere. Accordingly, there has been great interest in the development of aerosol dispensers that do not use chemical propellants, but which also retain the conveniences of use associated with the chemically charged dispensers.

Among the alternatives to chemically pressurized aerosol dispensers are various mechanically pressurized models using finger pumps and triggers. These typically require a continued vigorous pumping to produce a continuous spray, and, as a result, are inconvenient to use. Further, the duration of the spray is in most instances limited by (1) the length of the stroke of the pump or trigger, (2) the fact that the pressure of the spray in most instances does not remain constant during a discharge cycle but decreases rapidly near the end of the cycle with the spray becoming a wet stream or dribble, and (3) the fact that the device must generally be operated in an upright position. In addition, many of the finger-operated pumps are not capable of producing a fine mist or suitably atomized spray for use with such products as cosmetics and hair sprays. As a result, such devices only partially solve the problem of providing a convenient, yet safe alternative to chemically pressurized aerosol dispensers.

Other alternatives to chemically pressurized dispensers include various mechanically pressurized models that obtain prolonged spray time by storing a charge without the use of chemical propellants. Such "stored charge" dispensers include types that are mechanically pressurized at the point of assembly, as well as types that may be mechanically pressurized by an operator at the time of use.

Stored charge dispensers that are pressurized at the point of assembly often include a bladder that is pumped up with product. Examples include those described in U.S. Pat. Nos. 4,387,833 and 4,423,829.

Stored charge dispensers that are pressurized by an operator at the time of use typically include charging chambers that are charged by way of screw threads, cams, levers, ratchets, gears, and other constructions providing a mechanical advantage for pressurizing a product contained within a chamber. This type of dispenser will be referred to as a "charging chamber dispenser." Many ingenious charging dispensers have been produced. Examples include those described in U.S. Pat. No. 4,872,595 of Hammett et al., U.S. Pat. No. 4,222,500 of Capra et al., U.S. Pat. No. 4,174,052 of Capra et al., U.S. Pat. No. 4,167,941 of Capra et al., and U.S. Pat. No. 5,183,185 of Hutcheson et al., which is expressly incorporated by reference herein.

While some of the prior stored charge dispensers avoid some or all of the difficulties of the finger pump or trigger dispensers, the stored charge dispensers tend to have drawbacks of their own. In the devices pressurized at the point of assembly, the charging chamber is often an elastic bladder that remains charged during the life of the product, degrading over time, and these devices typically cannot be refilled with product. In the devices pressurized by an operator at the time of use, the charging chamber devices have been relatively difficult to manufacture due the large number of interrelated working parts required, and/or the fact that they are composed of parts not readily suited to high quantity, high yield injection molding production techniques, and/or the fact that they are required to be used with specially designed containers.

These drawbacks have tended to make the charging chamber dispensers expensive and not commercially feasible for mass market applications, and have tended to make other stored charge dispensers less than completely satisfactory substitutes for chemically pressurized dispensers. Accordingly, existing stored charge and charging chamber dispensers have only partially solved the problem of providing a convenient, yet safe alternative to chemically pressurized aerosol dispensers.

The current invention is a charging chamber dispenser that possesses specific improvements so that it combines convenience of use with commercial feasibility. It is believed that this is, finally, a non-chemical aerosol dispenser that retains the desirable features commonly associated with chemical aerosols, and is, therefore, a non-chemical aerosol dispenser that can attain widespread vendor and customer acceptance.

SUMMARY OF THE INVENTION

Accordingly, the mechanically pressurized aerosol dispensing system of this invention in one of the preferred embodiments consists essentially of: (a) a cap which houses a piston; (b) an actuator moveably attached to the cap, forming together with the cap a dispensing head assembly; and (c) an expandable elastic reservoir. The system is fitted over a standard container holding a liquid product, and includes a dip tube assembly to draw liquid into the dispensing head assembly, including an aerosol nozzle and valve, to release the contents out of the dispensing head assembly.

Complementary screw threads on the cap and actuator are selectively pitched so that a short twist of the threaded cap raises the piston, opening a charging chamber within the dispensing head assembly. This creates a vacuum with the resulting suction pulling the product up through the dip tube to fill the charging chamber. Twisting the cap in the opposite direction lowers the piston in a downstroke which closes the charging chamber, forcing the product into the expandable elastic reservoir. The reservoir expands under pressure, holding the product for subsequent discharge. Pushing a button, which is part of the standard valve assembly in the cap, releases the product through the nozzle.

The general working of the system briefly summarized above is enhanced by several specific improvements, including: (a) use of a snap-in piston so that the piston and the cap may be separately molded, allowing different materials for each and easier mold forms; (b) use of a container which is a separate piece from the dispensing head assembly, permitting easy filling of the container, and taking advantage of ordinary bottles and standard bottling technology; (c) use of a reservoir, piston and actuator in such a way as to realize the additional advantages of establishing a one-way valve mechanism for sealing the dip tube on the downstroke cycle, and also establishing a drain back mechanism for discharging undispensed product back into the container without the need of extra parts for either function, (d) use of a piston sealing mechanism which produces a tight seal while maintaining a low coefficient of friction so as to make the mechanical twisting motions of the cap and actuator easy, and (e) use of a flexible face fitment two-way valve mechanism for providing a positive shut off to reduce dribbling or seeping, while also preventing product build up behind the nozzle.

These and other specific improvements (and other embodiments) will be described in more detail later, and their significance will be explained. In summary, it is the cooperation of such elements as these in the system of this invention which results in a non-chemical aerosol that works from any position/orientation, even upside down, that does not require a finger pump to actuate, and that can be fitted to a wide variety of standard disposable or reusable containers. Further, the system of this invention produces a longer duration spray which does not become a wet stream or dribble near the end of the cycle, and a finely atomized high pressure spray which does not take inordinate mechanical force to charge. The system of this invention is simple and uses relatively few parts, all of which can be easily fabricated from existing materials and can be injection molded with existing mold techniques.

It is a specific objective of the system of this invention to solve substantially all of the problems that have, until now, prevented non-chemical aerosol dispensers from being widely accepted as the replacement for chemically pressurized aerosol dispensers.

BRIEF DESCRIPTION OF THE DRAWINGS

The accompanying drawings, which are incorporated in, and form a part of the specification, illustrate the preferred embodiments of the present invention, and together with the descriptions serve to better explain the principles of the invention.

In the Drawings

DETAILED DESCRIPTION OF THE INVENTION

With the above summary in mind, it may now be helpful in fully understanding the inventive features of the present invention to provide in the following description a thorough and detailed discussion of a number of specific embodiments of the invention.

Figure 1:
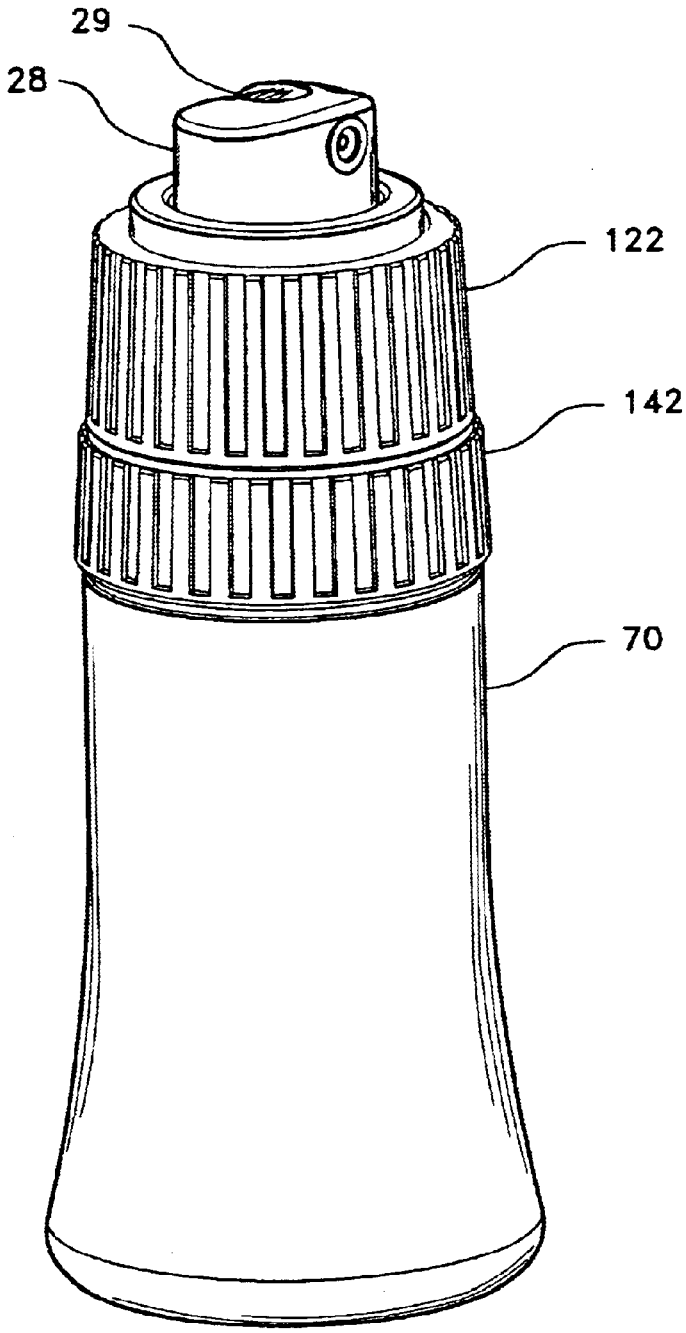
FIG. 1 is an offset front view of this invention particularly featuring the actuator, the acuator housing, and the collar cap.
Figure 2:
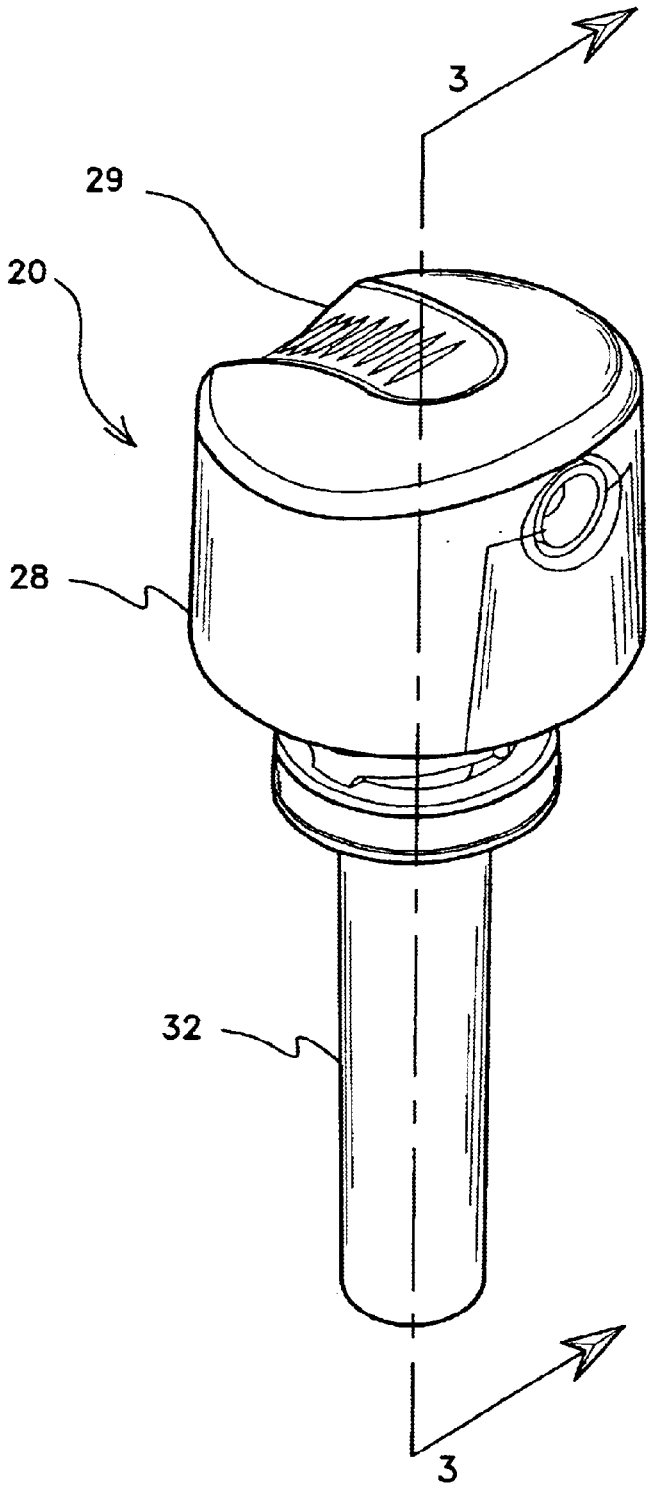
FIG. 2 is a front view of the actuator assembly of this invention shown here without a mechanical break-up unit (MBU).
Figure 3:
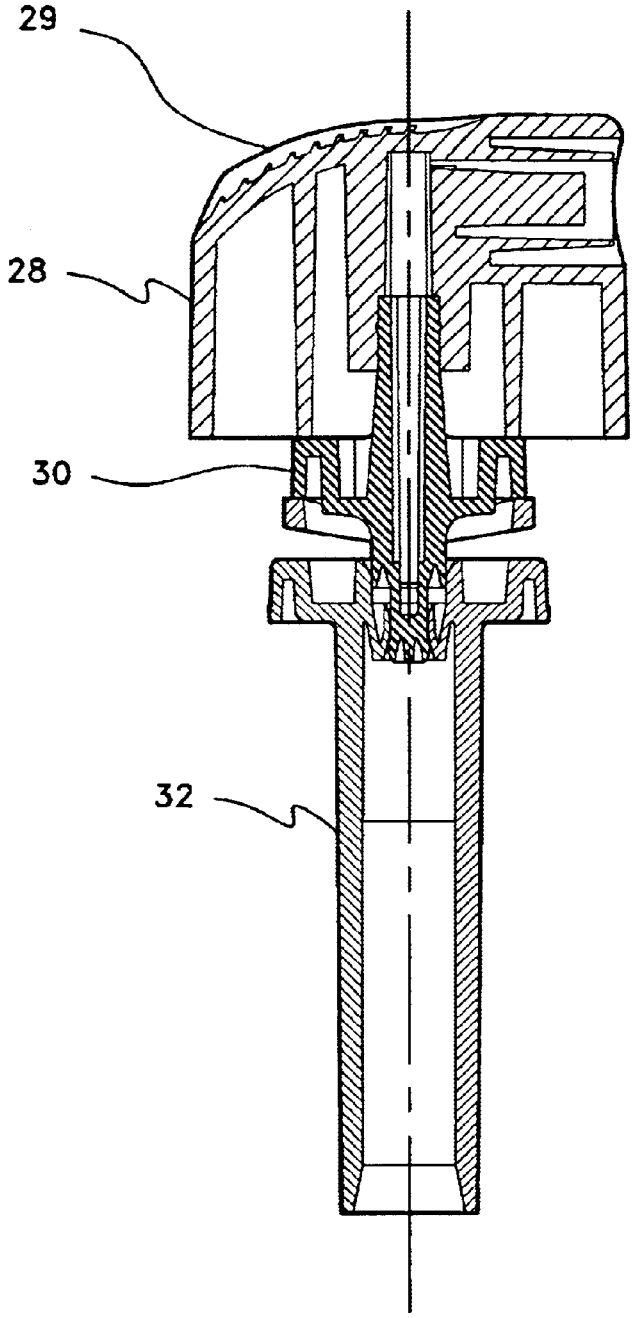
FIG. 3 is a sectional side view of the actuator assembly of FIG. 2, again shown without an MBU.
Figure 4:
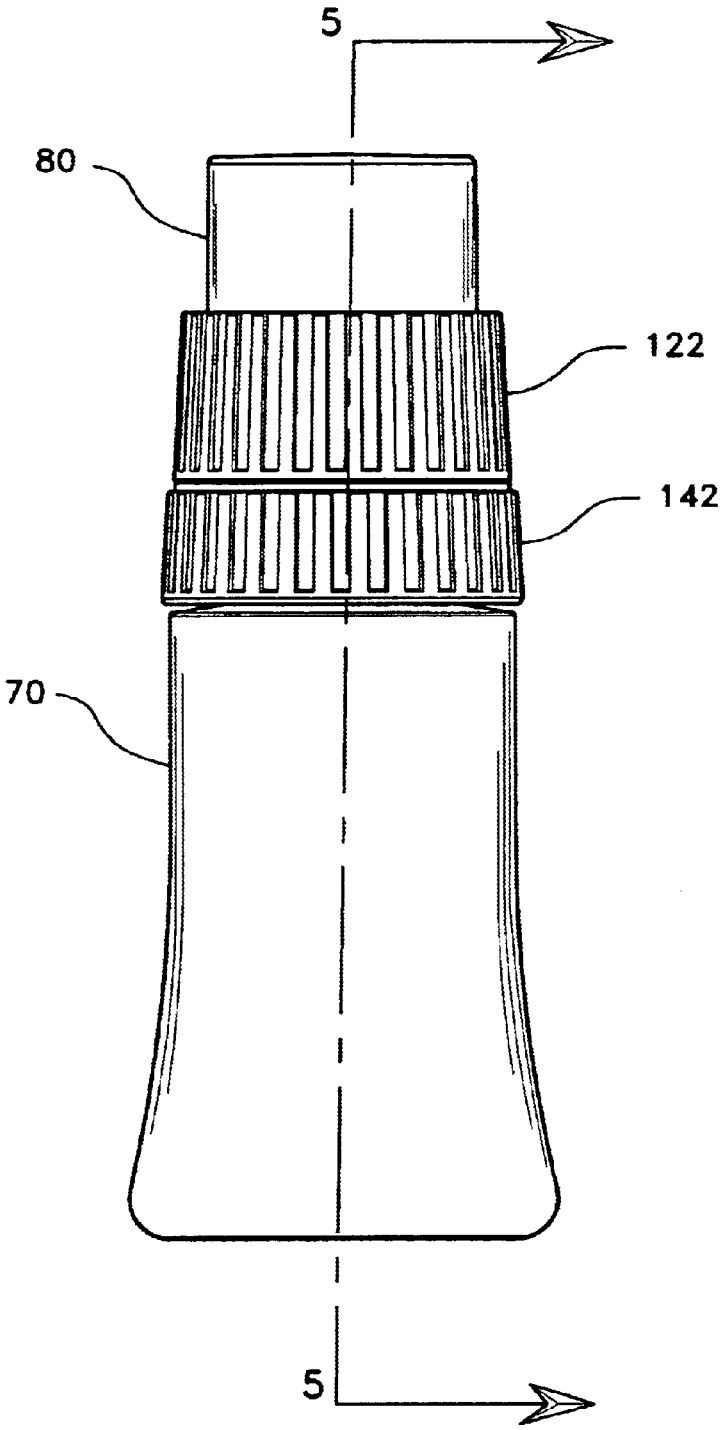
FIG. 4 is a side view of this invention showing the overcap, the actuator housing, the collar cap, and the container.
Figure 7:
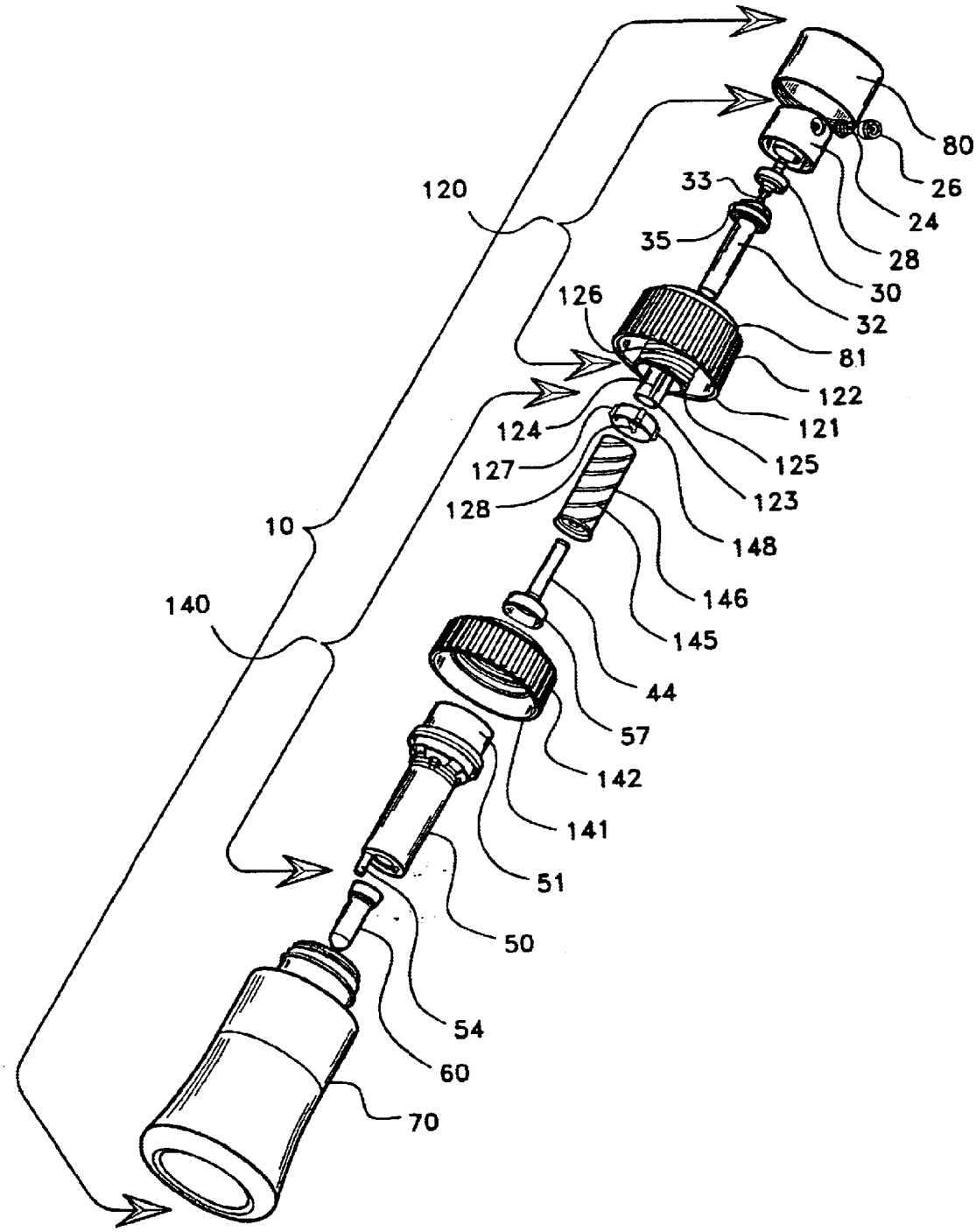
FIG. 7 is an exploded view of the individual components that together comprise the DHA model of FIGS. 5 and 6.
Figure 9:
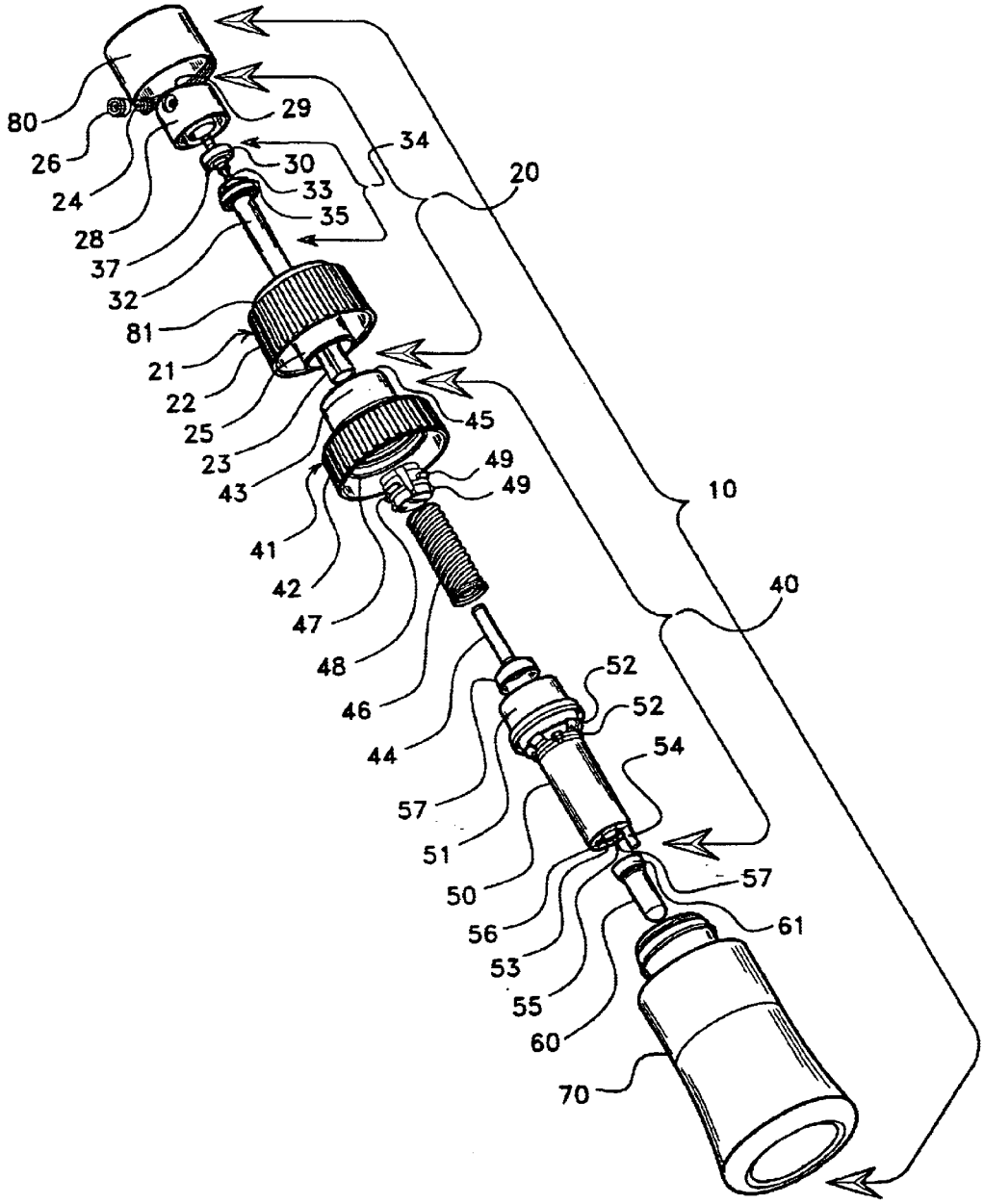
FIG. 9 is an exploded view of the individual components that together comprise the basic SHA model of FIG. 8.
Figure 11:
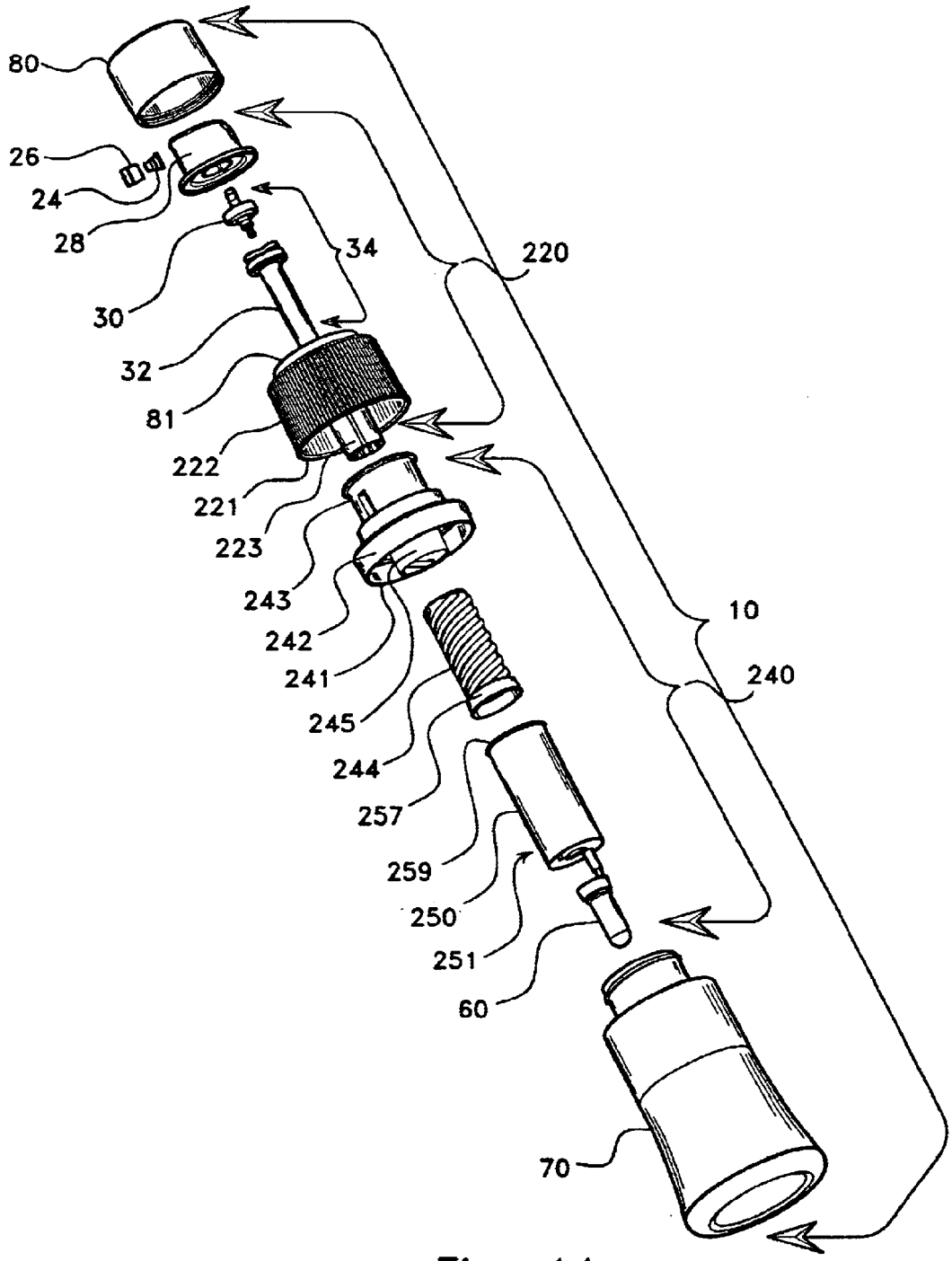
FIG. 11 is an exploded view of the individual components that together comprise a third embodiment of the dispenser invention shown in FIG. 4, the simplified single helix action (SHA) model, specifically showing the elimination of several parts as compared to the embodiments shown in FIGS. 7 and 9.

Most generally, and referring to FIGS. 1, 4, 7, 9 and 11 for purposes of illustration, it may be seen in overview that the non-chemical aerosol dispenser system 10 generally comprises an actuator assembly 20 (shown in FIGS. 2 and 3 without an actuator housing 22), a collar cap assembly 40, shown in FIG. 9 to include a threaded collar cap 42 housing a piston 44 in combination with a spindle 46, and interconnected with a cylindrical housing 50 by a piston collar 48, and an expandable elastic reservoir 60. As shown in FIGS. 7, 9 and 11, the dispenser system 10 fits onto the collar of a standard container 70. In all of the disclosed embodiments discussed below, the container 70 may be any standard container, and it does not need to be specially made to withstand a minimum gas pressure. Since the container 70 is not pressurized, it also does not need to be cylindrical or round in shape, nor does it need to be constructed with heavy or thick material. In fact, there are no apparent geometrical limitations placed on the container 70, thus enabling the dispenser system 10 to have a virtually unlimited range of possible consumer uses, including the possibility of its use with food products. Moreover, the container 70 can be disposable or reusable, and it can be filled and refilled readily with ordinary techniques known to those persons skilled in the art. In summary, unlike chemically propelled aerosols, the current invention is readily adaptable to a wide variety of products characterized by a wide variety of viscosities, surface tensions, formulations, etc., and it can further be configured in a wide variety of product-specific or consumer-specific packaging options. Such container interchangeability is well known by persons skilled in the art and is not further described herein.

The expandable elastic reservoir 60 as illustrated in all of the disclosed embodiments discussed below, is shown in FIGS. 7, 9 and 11, and is described as an elastomeric bladder, but it may be any kind of reservoir which can expand under pressure, thus storing a force. Accordingly, the reservoir 60 should be understood to represent, not only the elastomeric bladder of these embodiments, but more generally, a means for resistably expanding a reservoir under hydraulic pressure, including not only elastic reservoir containers, but also structures consisting of spring-loaded pistons and equivalent devices mounted within rigid and semi-rigid reservoir containers, including containers having springs embedded within, or affixed to, flexible materials. In fact, a spring-loaded reservoir would represent a viable alternative that would also represent a less expensive component. Such structures, however, are well known by those skilled in the art and are not further described herein.

Several embodiments of this invention are now disclosed, each comprising a core group of interconnected components, and each further comprising a standard container 70, an elastomeric bladder 60, and an actuator assembly 20 using a flexible face fitment 24 in combination with a compression fitment 26 as seen in FIGS. 5–9 and 11–13 and as described above.

Figure 5:
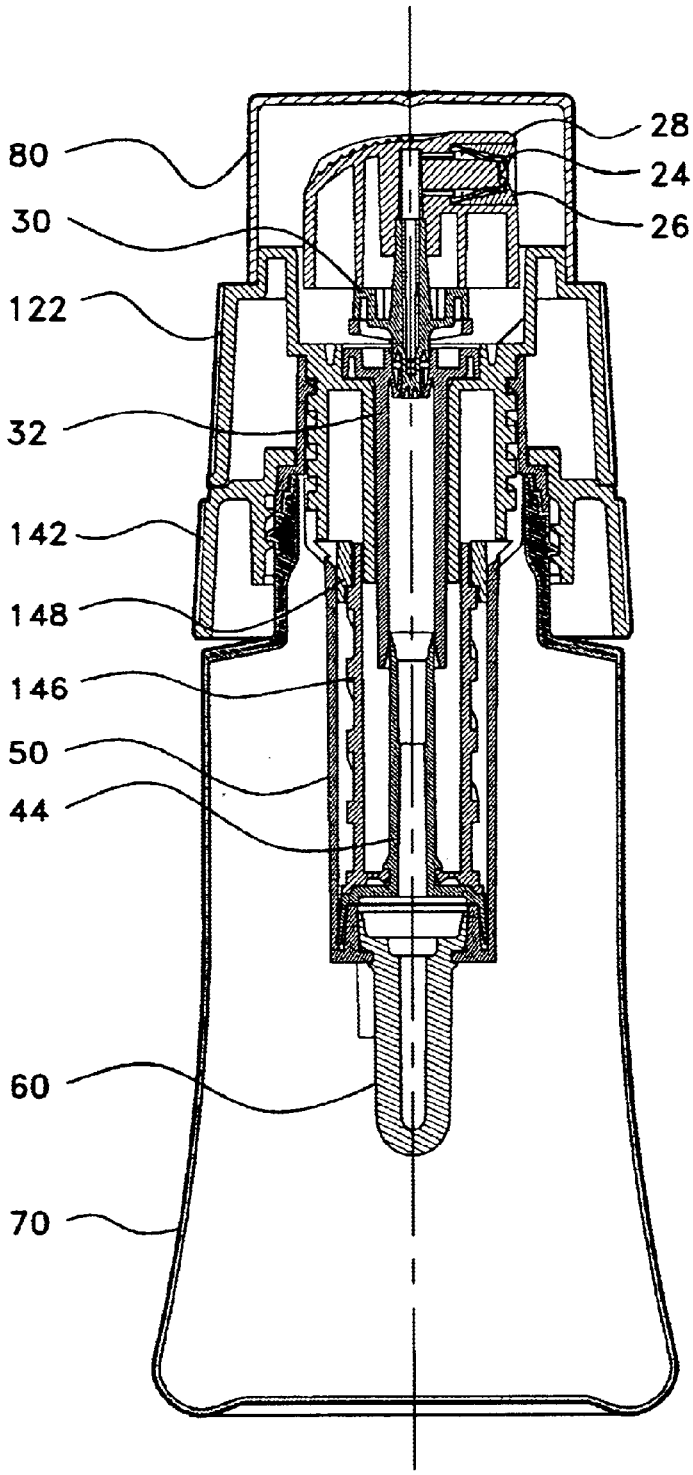
FIG. 5 is a sectional side view of one embodiment of the dispenser invention shown in FIG. 4, specifically the double helix action (DHA) model, which is shown here with the piston in the down position.
Figure 6:
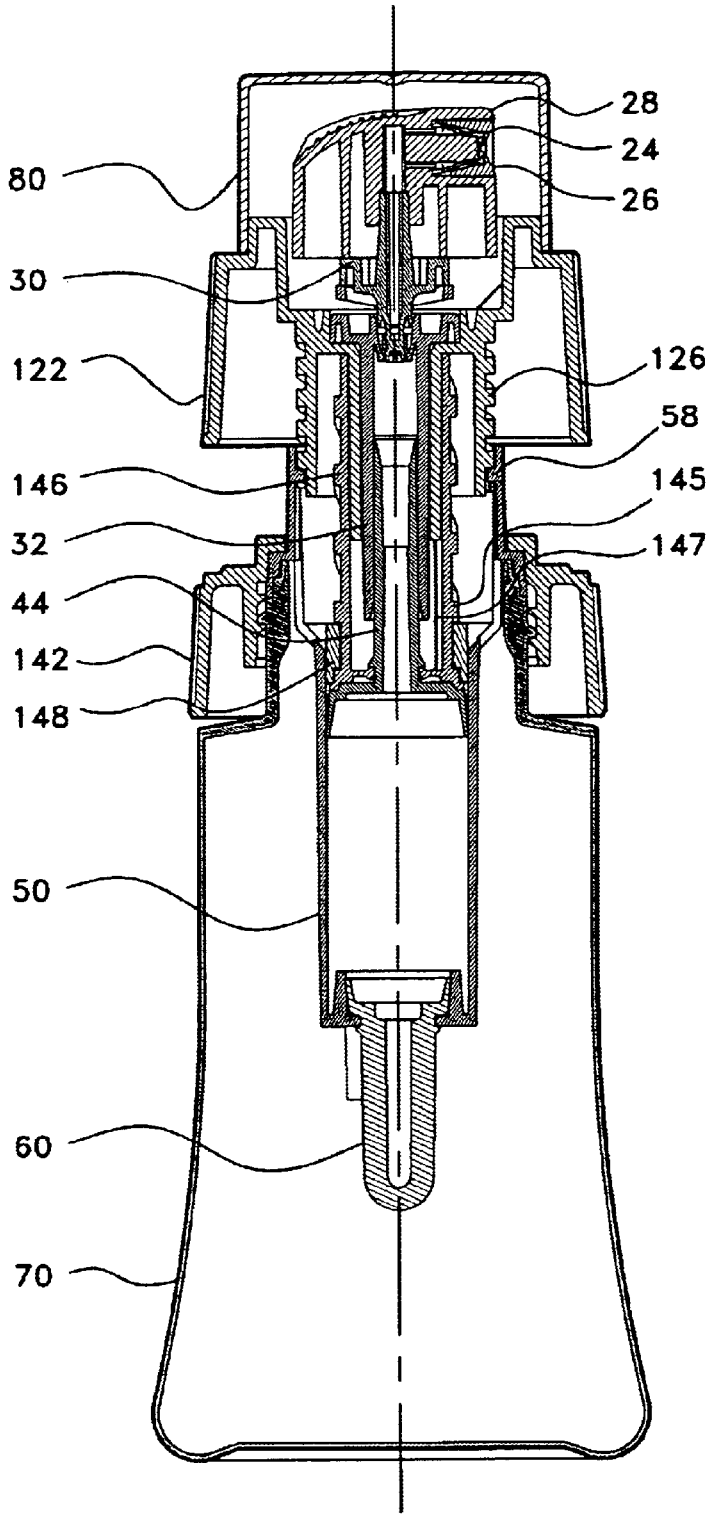
FIG. 6 is a sectional side view of the DHA model of FIG. 5, but is shown here with the piston in the up position.
Figure 8:
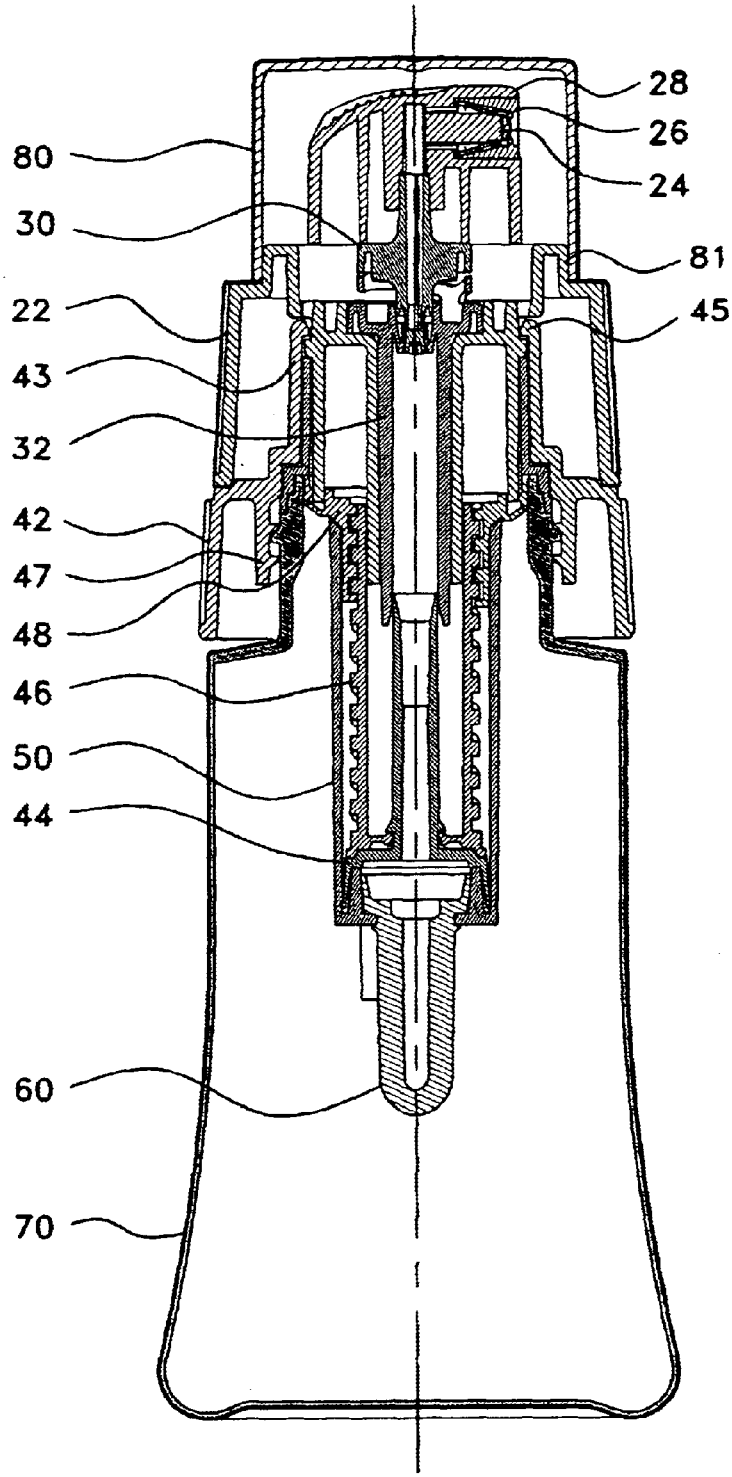
FIG. 8 is a sectional side view of a second embodiment of the dispenser invention shown in FIG. 4, specifically the basic single helix action (SHA) model, which is shown with the piston in the down position.

One embodiment, referred to as the double helix action (DHA) model, is illustrated in FIGS. 5–7. A second embodiment, referred to as the basic single helix action (basic SHA) model, is illustrated in FIGS. 8 and 9. Both models are comprised of essentially the same components, with minor variances in the geometries of the individual components. Both models specifically incorporate a piston head 57 and cylindrical housing 50, as illustrated generally in FIGS. 7 and 9, that are each smaller in their respective diameters then those disclosed in previously patented dispensers, which allow the DHA and the basic SHA models to generate longer upward and downward bore strokes than those generated by previously patented dispensers. The longer bore strokes are critical to the efficiency of this invention. The longer strokes allow additional product initially to be hydraulically drawn into the cylindrical housing 50, and subsequently forced into the elastomeric bladder 60, thus ultimately allowing the product to be dispensed with a longer duration spray that that generated by previously patented dispensers. Further, the DHA and basic SHA models featuring piston heads 57 and cylindrical housings 50 with smaller diameters respectively, require the application of less force to overcome the frictional forces working against the downstroke of the piston 44, thus making it easier for the user to operate the DHA and basic SHA models, and thus accommodating a wider range of users with otherwise limiting physical conditions, i.e., arthritis.

Figure 12:
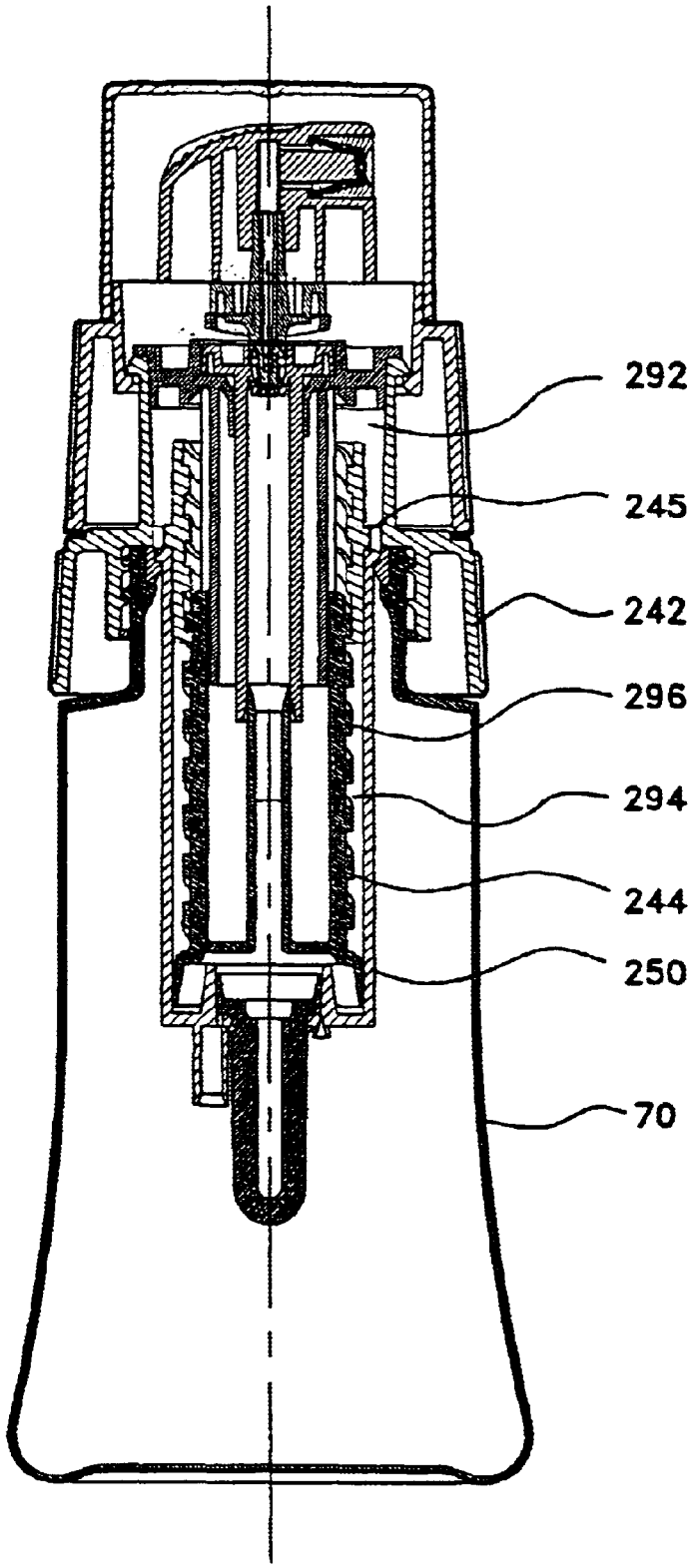
FIG. 12 is a sectional side view showing the embodiment of FIG. 11 with the piston in the down position.
Figure 13:
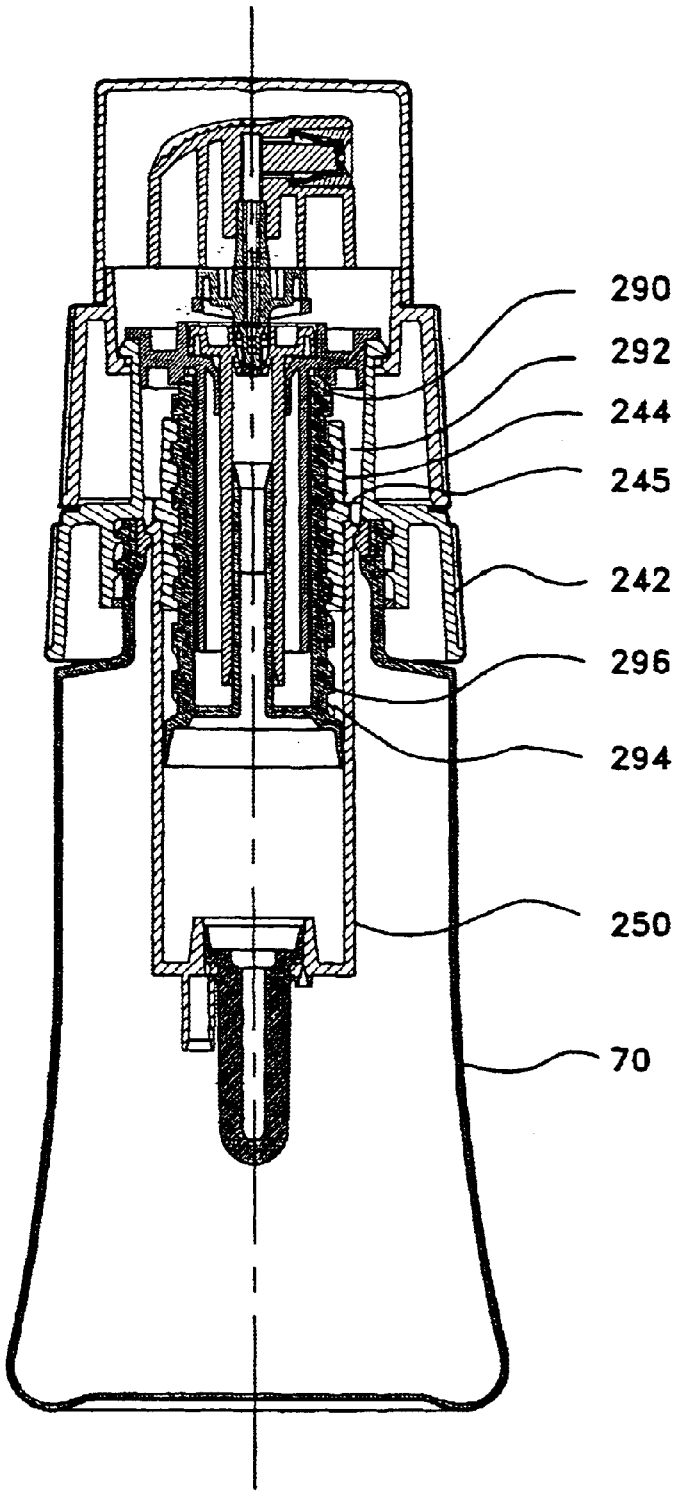
FIG. 13 is a sectional side view showing the embodiment of FIG. 11 with the piston in the up position.

A third embodiment, illustrated in FIGS. 11–13 and referred to as a simplified SHA model, is manufactured using fewer components than basic SHA model, and it features a piston head 257 and cylindrical housing 250 with slightly larger diameters respectively than either the DHA model or the basic SHA model. In the simplified SHA model, the piston head 257 and cylindrical housing 250 have diameters of approximately 1.0 inch as compared to the piston head 57 and the piston housing 50 of the previous two models that have diameters measuring approximately 0.782 inches. This increase in diameter of each component 250, 257, while simultaneously leaving the size and space of the threads of the spindle 46, 146 and the grooves of the piston collar cap 48, 148 unchanged, leaves the length of the piston 44 and the length of the cylindrical housing 50 unchanged. By making this slight modification, the simplified SHA model is able to increase the amount of product ultimately charged in the elastomeric reservoir 60, thus increasing the duration of the product spray upon activation.

Further, while the increase in the size of the piston head 257 requires a user to apply more force to overcome the frictional forces working against the downstroke of the piston 244, the simplified SHA model only requires one turn of its actuator housing 222 to fully charge the elastomeric reservoir 60 versus the 1¾ turns required of the actuator housings 22, 122 for both of the smaller head 57 models illustrated in FIGS. 7 and 9. In all three embodiments, the disclosed diameters of the respective pistons heads 57, 257 and cylindrical housings 50, 250 are exemplary for purposes of illustration. Those persons skilled in the art will appreciate that by simply changing the relative diameter sizes of the piston heads 57, 257 and the cylindrical housings 50, 250, the amount of product hydraulically withdrawn from the container 70 and forced into the elastomeric reservoir 60 will be varied accordingly. Alternately, changes in the relative pitch of the threads of the spindle 46, 146 and the grooves of the piston collar cap 48, 148 and/or changes in the relative length of the piston 44 or the cylindrical housing 50, will likewise vary the ultimate product output as those persons skilled in the art will appreciate and as will be discussed in more detail below.

Both the DHA model shown in FIGS. 5–7 and the SHA model shown in FIGS. 8 and 9 are comprised of the following common components: an actuator housing 22, a flexible face fitment 24, a compression fitment 26, a turbo-actuator 28 (otherwise referred to as a MBU), a valve stem seal 30, a spring valve retainer 32, a collar cap 42, 142, a piston 44, a spindle 46, 146, a piston collar 48, 148, a cylindrical housing 50, a reservoir bladder 60, and an overcap 80. The actuator assembly 20, 120 as shown in the embodiments illustrated in FIGS. 7 and 9, generally comprises the actuator housing 22, 122, the flexible face fitment 24, the compression fitment 26, the turbo-actuator 28, the valve stem seal 30, and the spring valve retainer 32. For a detailed summary of the structural composition of, and the mechanical operation of the actuator assembly, U.S. patent application Ser. No. 09/748,730, filed on Dec. 26, 2000, is attached hereto in its entirety and is incorporated expressly herein by reference. The actuator assembly therein disclosed by Blake is representative of the actuator assemblies incorporated in each of the disclosed embodiments of the present invention. Such an actuator assembly creates a discharge pathway through which product is dispensed, such that the flexible face fitment flexes away from two shutoff mating surfaces at a predetermined minimum pressure and then flexes back into sealing contact with the two shutoff mating surfaces when the product pressure drops below this minimum pressure. This results in a product that is dispensed in a fairly constant pattern that then shuts off abruptly, allowing negligible product dribbling as the pressure decreases and minimal product build-up behind the valve.

Figure 10:
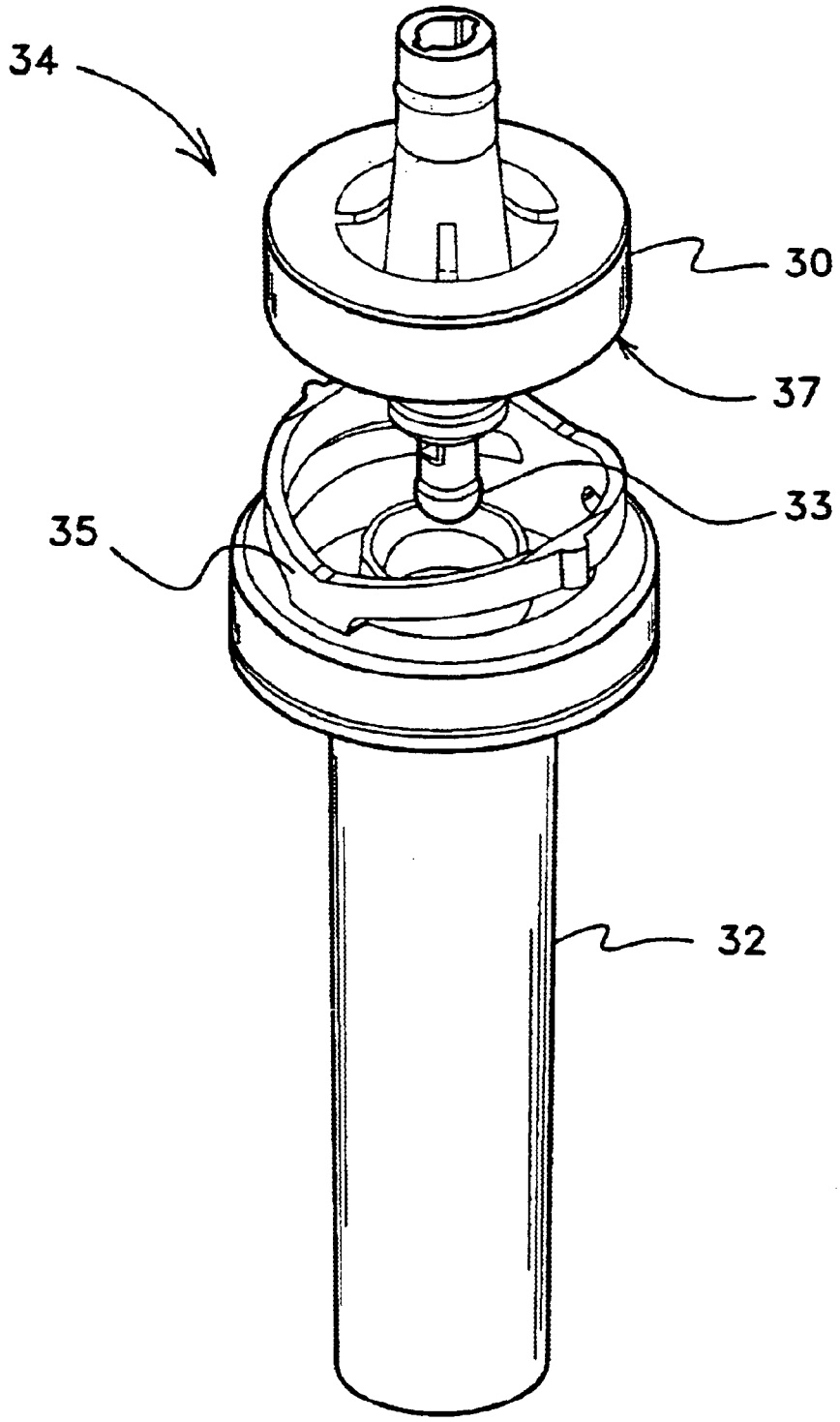
FIG. 10 is a blown-up representation of the two-part valve mechanism that is integral to each of the embodiments of this invention.

Referring to FIG. 9 for general purposes of illustration and FIG. 10 specifically, one novel feature of this invention that is common to all three models is the introduction of a valving mechanism 34, comprised of the valve stem seal 30 and the spring valve retainer 32, upon which the atomizing turbo actuator 28 sits. Once the reservoir bladder 60 has been charged up to the desired capacity, the valving mechanism 34 stands ready to be activated, which occurs when the button 29 on the turbo actuator 28 is depressed, thus allowing the contents of the reservoir 60 to discharge. The two components 30, 32 of the new valving mechanism 34 essentially replace five components that have been standard in most other previously disclosed aerosol valves. Common to the prior designs, stem valves just rested within the spring valve retainers while the actuators were locked or retained into position to inhibit the valve action via two wings at the base edge, which retained the assembly by snapping into windows molded into the upper body structure. The new valving mechanism 34 eliminates these unnecessary retention means by virtue of the geometry of the valve stem seal 30, which has a bulbous contoured tip 33 that flexes into a pocket within the spring valve retainer 32, thus seating itself so as to be permanently retained. Further assisting with the retention of the valve stem seal 30 within the spring valve retainer 32 is the leaf spring 35 that flexes upon the downward pressure of, and engages the outer lip 37 of, the valve stem seal 30.

Referring to FIGS. 7, 9 and 11, the actuator housings 22, 122, 222 and the collar caps 42, 142, 242 of the three disclosed models form the pressurizing mechanism of this dispenser system 10. Components 22, 122, 222, and 42, 142, 242 are each essentially circular in shape, and along with the rest of the components of the dispenser system 10 (with the exceptions of the flexible face fitment 24 and the compression fitment 26), are positioned symmetrically around a common vertical axis. Actuator housings 22, 122, 222 and the collar caps 42, 142, 242 also each feature an alternating grooved surface upon their respective circular outer walls 21, 121, 221, and 41, 141, 241 so as to facilitate a non-slipping grip by the consumer. The pressurizing mechanism is activated when a system user grips the outer wall 21, 121, 221 of the actuator housing 22, 122, 222 with one hand, grips the outer wall 41, 141, 241 of the collar cap 42, 142, 242 or alternatively, the container 70 with the other hand, and proceeds to twist the actuator housing 22, 122, 222 counter-clockwise while simultaneously holding the collar cap 42, 142, 242 or the container 70 motionless. In each of the three disclosed models, the twisting steps are the same, i.e., the actuator housing 22, 122, 222 action is reversed, that is, it is twisted clockwise while the collar cap 42, 142, 242 or the container 70 is held stationary in order to complete the pressurizing or priming of the dispenser system 10.

In each of the three disclosed models, and illustrated in FIGS. 7, 9 and 11, an inset upper lip 81 of the actuator housing 22, 122, 222 creates an engaging means by which overcap 80 is seated to protect the activating button 29 from accidental discharge while the system 10 is in storage or while it is in transit. Such engaging means can be any of a wide variety of mechanical features that allows the overcap 80 to be securely fastened to the actuator housing 22, 122, 222 and yet also easily removed for operation of the dispenser system 10. Such engaging means are well known to those persons skilled in the arts and will not be further discussed herein.

Referring specifically to FIGS. 5–7, the actuator housing 122 of the DHA model has an inner circular wall 123 that defines a space within its circumference through which the spring valve retainer 32 portion of the actuator assembly 120 is seated. The space within the circumference of the inner circular wall 123 is defined by the diameter that is slightly larger than the diameter of the spring valve retainer 32, such that there is minimal clearance between the two components 123, 32 that creates a minimal frictional force between the two components 123, 32 upon operation of the system 10. Between the grooved outer circular wall 121 and the inner circular wall 123 of the actuator housing 122, there is an intermediate circular wall 125, extending below the outer wall 121 in length, but not extending below the length of the inner wall 123. The intermediate wall 125 is threaded, a feature which gives rise to the "double" helix action observed during the enactment of the pressurizing mechanism as will be further described below.

In each of the three models disclosed, the pressurizing mechanism is engaged initially by a first action generated by the upstroke of the piston 44, as shown generally in FIG. 6. As particularly shown in the figures, the first action occurs when a user applies an external rotating force that twists the actuator housing 122, engaging grooves 124 of inner circular wall 123 with ribs 147 of spindle 146, thereby providing rotation of spindle 146. Correspondingly, when a user applies an external rotating force that twists the actuator housing 122, threads 126 of intermediate wall 125 engage lugs 58 of outer circular wall 51 of housing 50. In some embodiments, lugs 58 may comprise bayonet lugs, ramp lugs, or the like. The engagement and configuration of the threads 126 and the lugs 58 provide for an upward motion of the actuator housing 122 when the actuator housing 122 is twisted or rotated in a direction. Further, lugs 127 of piston collar 148 engage with one or more elements of cylindrical housing 50, such as windows, and the lugs 128 of piston collar 148 engage with threads 145 of spindle 146, providing an upward motion of spindle 146 and linear travel of piston 44 upon twisting the actuator housing in a direction. Therefore, piston 44, which is connected to the spindle 146, will linearly travel during the upstroke of the piston 44 and spindle 146. As the spindle 146 and piston 44 withdraw from the cylindrical housing 50 during the course of the first action, product is pulled out of the container 70 through the dip tube acceptor port 54 and is deposited within the cylindrical housing 50. The second action commences with the counter-directional twisting of the actuator housing 122 and a corresponding rotation of inner circular wall 123 and spindle 146, a downward motion of actuator housing 122, and a downward motion and linear travel of spindle 146 and piston 44, provided by the mechanical relationships described above. As the spindle 146 and the attached piston 44 travel downward, the product is forced out of the cylindrical housing 50 and into the elastomeric bladder 60, thus priming the dispenser system 10 prior to the activating button 29 being depressed. As will be recognized by persons skilled in the art, the quantity and type of product dispensed by such a system 10 can be varied by changing either the spacing between and/or pitch of the threads of the spindle 146 and the lugs of the interfacing piston collar 148.

Continuing to refer generally to FIG. 7, similar changes can also be made with respect to the distance between and the pitch of the threads on the intermediate wall 125 of the actuator housing 122. Further, by altering the spacing and pitch of the threads of the spindle 146 and the lugs of the interfacing piston collar 148, as well as the internal threads of the actuator housing 122 and lugs 58 of outer circular wall 51, products of various viscosities, surface tensions, formulations, etc. can be selected for a variety of specific applications. These variations will be discussed in greater detail below in reference to SHA embodiments. In this particular embodiment, the double helix action described above results in the deposition of the maximum amount of product within the elastomeric reservoir 60 as well as the maximum amount of product ultimately dispensed.

By contrast, FIG. 9 shows that the intermediate wall 25 of the basic SHA model is essentially smooth and is shaped such that it accepts the upper inner wall 43 of the collar cap 42 so as to more effectively facilitate the counter-directional twisting of the actuator housing 22 and the collar cap 42 during the pressurizing step, while also providing a significant degree of registration between the two components 22, 42. In both the DHA model and the basic SHA model, the twisting of the actuator housing 122, 22 forces the spindle 146, 46 which is attached to the piston 44, to travel via its threads either upward or downward along the grooves of the piston collar 148, 48 and/or along the grooves of the intermediate circular wall 125, thus mechanically providing the force necessary to withdraw product from the container 70, deposit it first within the cylindrical housing 50 and then ultimately within the elastomeric reservoir 60 to complete the charging of the dispenser system 10. The mechanical advantage to these embodiments, referred to generally as a floating track and rail system design is that, with minimal effort, a single twist of the two components of DHA model (or 1¾ turns of basic SHA model, which would require the application of even less force by the user) generates a substantially long bore stroke, which translates into the acquisition of a large volume of product, which is then ready to be dispensed. This large volume of product is then capable of being sprayed consistently for a long period of time, i.e., 12–15 seconds, before the mechanical charge built up in the system 10 dissipates. In combination with the non-clogging flexible face actuator assembly's precise shut-off capability, this translates into a mechanical aerosol dispenser that has dispensing qualities comparable to those historically only found in chemical aerosol dispensers.

Referring again to FIG. 9, the upper inner wall 43 of the collar cap 42 of the basic SHA model is essentially smooth and further includes an inner circular rim 45 formed within the interior of the cap 42 that provides the structure against which the cylindrical housing 50 seats. The collar cap 42 also provides a lower inner circular wall 47, slightly outset from the upper inner wall 43 that has threads upon its interior surface such that the collar cap 42 can be threadably connected with the standard container 70 housing the desired product.

Continuing to view FIG. 9, the outer circular wall 51 of the cylindrical housing 50 of the basic SHA model defines an annular space at its top that has a diameter large enough to accept the piston 44, the piston collar 42, and the spindle 46. The circular bottom 53 of the cylindrical housing 50 extends radially inward from the outer circular wall 51. It is not a solid bottom, however, and the inner circular edge 55 of the bottom 53 defines an inner space through which the reservoir bladder 60 protrudes and upon which the piston 44 comes to a final resting position. The cylindrical housing 50 includes several windows 52 that allow for a snap fit connection to the several corresponding lugs 49 of the piston collar 48, provided in some embodiments as wing lugs, so that the piston 44 and spindle 46 are able to move securely up and down within the cylindrical housing 50 along the lugs 128 of the piston collar 48, similar to the travel means described for the DNA model above.

The cylindrical housing 50 illustrated in FIG. 9, further includes a dip tube acceptor port 54 protruding from its bottom as well as a bleed back feature 56, located in this embodiment, approximately 180° away, i.e., substantially opposite from the dip tube acceptor port 54. The acceptor port 54 allows a dip tube (not shown) to be attached that provides a product pathway from the standard container 70 up into the cylindrical housing 50, from where it then travels up through the actuator assembly 20 during the dispensing cycle. The bleed back feature 56 allows an overcharged reservoir bulb 60 to release some product back into the standard container 70, thus reducing the pressure during the storage of the charge. In this embodiment, the bleed back feature 56 is conical in shape with the apex of the cone consisting of a webbing that, when pierced in the manufacturing process, forms the pathway for fluid to travel from the bulb 60 to the container 70. Those persons skilled in the art will recognize that the geometry of the bleed back feature 56 controls the fluid's drop size and the rate at which the drops travel back to the container 70. A wide range of geometrical shapes and sizes of bleed back features 56 can be selected depending on the objectives of each system and the type (i.e., viscosity, formulation, etc.) of product utilized.

FIG. 9 further illustrates the piston 44 itself as a narrow tube seated upon a circular head 57 that is raised up along with the spindle 46 within the cylindrical housing 50 upon the initial counter-directional twisting of the actuator housing 22 and the collar cap 42, and forced back down into the cylindrical housing 50 until it rests upon the cylindrical housing bottom 53 upon the reverse counter-directional twisting of the two components 22, 42. The up and down motion of the piston 44 within the cylindrical housing 50 provides the mechanical force needed to pull product from the standard container 70 up into the cylindrical housing 50 as described above. From the cylindrical housing 50, the product is forced into the elastomeric bladder 60 upon the downstroke of the piston 44. When the activating button 29 is depressed, the product is dispensed up through the actuator assembly 20. As described above, the piston 44, connected to the spindle 46, travels up and down within the cylindrical housing 50 due to the twisting of the collar cap 42 which engages the threaded outer wall of the spindle 46, that is connectedly joined to the collar cap 42 through the snap fitting of the piston collar 48. This action provides for an upward motion of the piston 44 and spindle 46 in the first directional instance, and a downward motion of the piston 44 and spindle 46 in the second, reversible directional instance.

Continuing to refer to FIGS. 8 and 9, the lip 61 of the reservoir bladder of the basic SHA model is seated within an upstanding wall 57 extending radially upward from the bottom 53 of the cylindrical housing 50 while the rest of the reservoir bladder 60 protrudes through the inner annular space defined by the inner circular edge 55 of the bottom 53 of the cylindrical housing 50 extending down into the standard container 70. As described above, upon the downward motion of the piston 44 and spindle 46, the reservoir bladder 60 becomes charged with a hydraulic pressure differential created within the cylindrical housing 50. Upon the release of the pressure through the depressing of the activating button 29, the reservoir bladder 60 is discharged and the equilization of the hydraulic pressure differential within the cylindrical housing 50 allows any excess product to be dispensed within the standard container 70. On the upward stroke of the piston 44, product travels through the port acceptor 54 and into the cylindrical housing 50 where it awaits dispensing. The overcap 80, which seats itself over an inset outer retaining wall 81 extending above the actuator housing 22, serves solely to protect the actuator housing 22 from accidental discharge prior to use.

Thus with the exception of the geometries of the respective actuator housings 22, 122, the piston collars 48, 148, and the spline patterns on the spindles 46, 146, the basic SHA model and the DHA model, as illustrated in FIGS. 5–7 and 8–9, generally comprise the same components in combinations that are described above. The advantages created by the two embodiments include the abilities of both to obtain long bore strokes versus the strokes of previously disclosed dispensers. Further, the DHA model, as shown in FIGS. 5–7, exhibits an additional mechanical advantage due to the spline-to-rib engagement via two modes that simultaneously move the mechanism down with one twist/turn on the actuator housing 122, utilizing a back and forth radial motion that produces twice the travel of the piston 44 and spindle 146 within the cylindrical housing 50, thus more readily facilitating the hydraulic charging of the reservoir bladder 60. While the stroke takes place, the actuator housing 122 moves upwards by one-half of the entire stroke.

By contrast, the basic SHA model, shown in FIGS. 8–9, features the same diameter piston 44 and spindle 46 combination that are used in the DHA model, but is differentiated by the reduction by one-half stroke when the upper mode of travel is removed, thereby forcing the lower mode to provide the remaining travel for the other half of the required stroke. Regarding other geometrical and functional aspects, however, the two embodiments are essentially similar.

A third embodiment, referred to as the simplified SHA model, features a slightly larger diameter piston 244, is illustrated in FIGS. 11, 12 and 13. One difference between this embodiment and the DHA model and the basic SHA model, is that it features less components and thus creates a simpler product to manufacture. In the simplified SHA model, the piston head 257 as shown has an approximately 1.0 inch diameter versus the approximately 0.782 inch diameter represented by the piston head 57 in the previous two embodiments. Again, it is important to note that the diameter specified is not intended to be limiting in any way; rather, the relative proportionality of the piston head 57, 257 and cylindrical housing 50,250 and/or the relative proportionality of the threads of the spindle or piston 46, 146, 244 and the grooves of the piston collar cap 48, 148, 245 and/or the length of the piston 44, 144, 244 and the length of the cylindrical housing 50, 250 are more important, as the proportional increasing or decreasing of the sizing of these components will accommodate a variety of product applications as will be readily appreciated by those persons skilled in the art.

In particular, the simplified SHA model features combining several of the individual components from the previously described embodiments during the manufacturing process, while retaining the primary function and the beneficial features of the general dispenser system 10. Referring to FIG. 11, the piston 44 and spindle 146, 46 of both the DHA model and basic SHA model are replaced by a single component referred to as a threaded piston 224. Similarly, the piston collar 148, 48 and the collar cap 142, 42 of the DHA model and of the basic SHA model have been replaced by a single component referred to as the threaded collar cap 242.

Continuing to view FIG. 11, although both threaded collar cap 242 and actuator housing 222 have been geometrically modified relative to their DHA model and basic SHA model counterparts, there are many similarities between the three models. The threaded collar cap 242 and the actuator housing 222 of simplified SHA model still feature the alternating grooved surfaces of their respective circular outer walls to facilitate a non-slipping grip by the user. Thus, the pressurizing mechanism remains the same as in the two previously disclosed embodiments. Further, the threaded collar cap 242 retains the internal threading required to threadably connect with the standard container 70 housing the desired product.

FIG. 11 also illustrates that one of the few geometrical differences between the three models is that the newly constructed actuator housing 222 features only an outer circular wall 221 and an inner circular wall 223. The space defined within the inner circular wall 223 still accepts the spring valve retainer 32 as it does in the DHA model and the basic SHA model, which itself accepts the valve stem seal 30 (comparable to the other two models as seen in FIGS. 7 and 9). The threaded piston 244 travels up the internal threading of the lower inner circular wall 245 of the threaded collar cap 242. The lower inner circular wall 245 of the threaded collar cap 242 acts essentially as the threaded collar cap 48, 148 of the basic SHA model and the DHA model respectively, extending beneath the outer circular wall 241. Further, the threaded collar cap 242 features an upper inner circular wall 243, similar to the upper inner circular wall 43 of the basic SHA model, that seats within the annular space formed between the outer circular wall 221 and the inner circular wall 223 of the actuator housing 222. Finally, the geometry of the cylindrical housing 250 of the simplified SHA model is different from the cylindrical housing 50 of both the basic SHA model and the DHA model. Instead of comprising windows 52 with which to engage the lugs 49 of the threaded collar 48 of the basic SHA model, it features an essentially smooth outer circular wall 251 with a retaining lip 259 encircling its upper end that provides a registration means by which to attach to the threaded collar cap 242.

Figure 14:
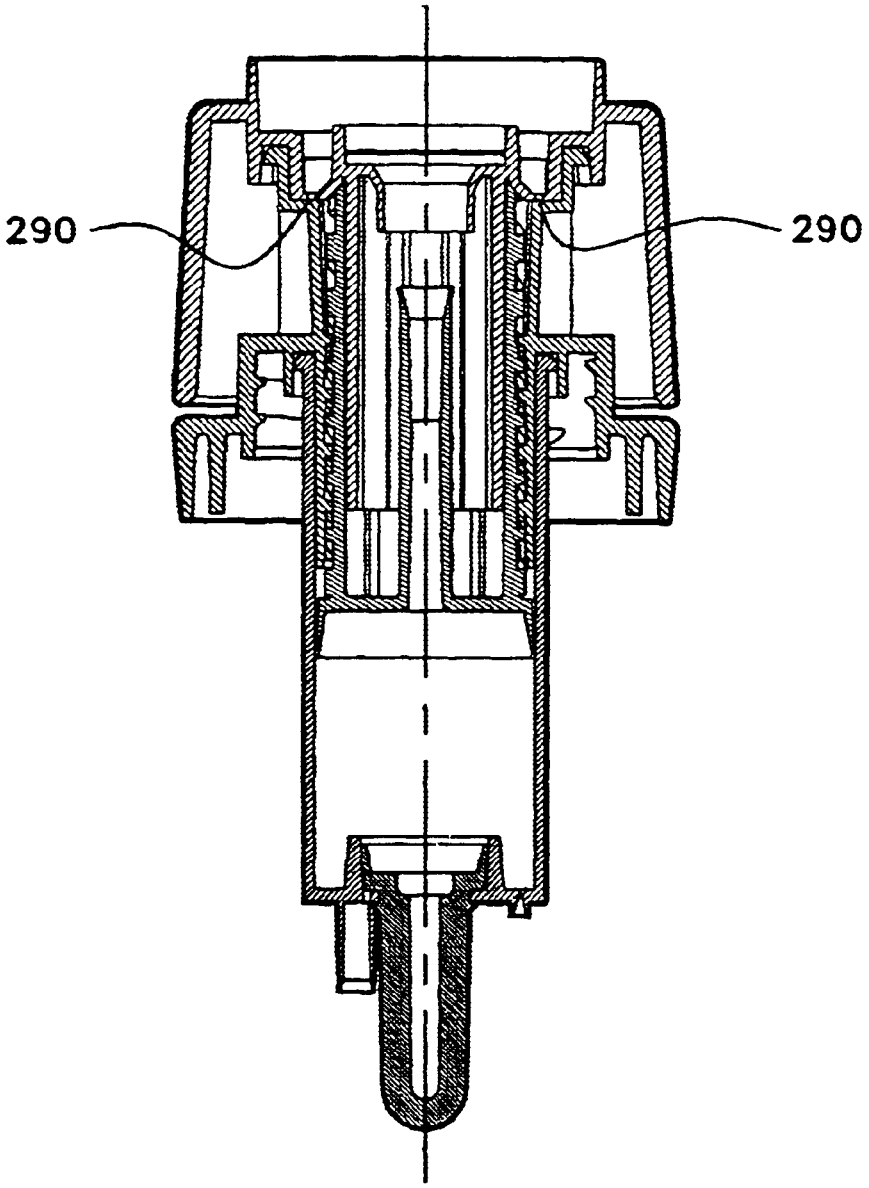
FIG. 14 is a sectional side view showing the embodiment of FIG. 11, as a sectional side view in 90 degree rotation from the cross-section of FIG. 12, particularly pointing out the vent holes, open to the atmosphere when the piston is fully extended, which allow the system to re-establish equilibrium.

In respect of several components of the SHA model, the dispenser system 10 may be considered to be more simple both in operation and in manufacture. Futhermore, a venting means is disclosed. While all three embodiments include a venting system—it is required because the dispensing system 10 is considered open, wherein ambient air needs to be replaced when product is dispensed during the replenishing cycle of the dispensing sequence in order to offset the vacuum conditions created during the hydraulic priming. The venting system incorporated in the simplified SHA model is the most efficient. Referring to FIGS. 12, 13 and 14, the venting means include a pair of vent holes 290, located approximately 180° apart, and a pair of helix chambers, an upper helix chamber 292 and a lower helix chamber 294. Functionally, when the vent holes 290 are open, i.e., when the threaded piston is at the apex of its downstroke, ambient air is allowed to enter the dispenser system 10 thus establishing an offset to the vacuum conditions created by the hydraulic priming and recreate an equilibrium condition within the system 10. The ambient air enters the upper helix chambers 292 and carries through the window-to-latch configuration interface between the threaded collar cap 242 and the cylindrical housing 250. Ambient air is also exchanged between the helix threads 296 of the interface between the cylindrical housing 250 and the lower circular inner wall 245 of the threaded collar cap 242 as the threads of the threaded piston 244 travel up and down the internal threads of the lower inner circular wall 245 of the threaded collar cap 242. This telescoping action of the helix threads 296 with the air exchange feature, facilitates the system's functioning attributes to aid in maintaining a pressure equilibrium within the container 70 relative to the ambient environment outside, and at the same time, allows air exchange throughout the dispensing stroke as well as the replenishing stroke.

Continuing to refer to FIGS. 12, 13 and 14, the two above-discussed situations occur only through the opening of the vent holes 290, which occurs within every approximate 90° rotation during the telescoping action described above. In each cycle, there is only a full turn forward and backward that delivers approximately 15 seconds duration of spray with the vents holes 290 being open or closed throughout this cycle. Thus, the system 10 remains in a sealed "vents closed" position during the period in which the threaded piston 244 is fully retracted. For this reason, the system 10 will be assembled to the container 70 in a mode where the piston is fully extended and shipped to the user as a sealed container in this same configuration.

The foregoing description is considered as illustrative only of the principles of the invention. Furthermore, since numerous modifications and changes will readily occur to those persons skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

What is claimed is:

1. A mechanically pressurized system for dispensing product, comprising:

(a) an actuator assembly, the actuator assembly further comprising an actuator having an outlet for dispensing the product, a valve for selectively routing the product to the outlet, and an actuator housing, therewith connecting the valve, the actuator further having an activating mechanism, which when triggered, forces the product first through the valve and then through the outlet;

(b) a piston assembly, the piston assembly further comprising a piston housing, the piston housing further comprising an inlet for drawing the product into the piston housing, and wherein the piston housing is further capable of accepting a piston in combination with a spindle, and wherein the spindle comprises an inner wall and an outer wall, the outer wall further comprising a set of threads allowing the piston in combination with the spindle to linearly travel housing, and wherein the piston assembly further comprises a collar cap, and wherein the collar cap is capable of seating a piston collar, the collar cap further being capable of connectably engaging the piston housing, and wherein the piston assembly further comprises a means for connectably engaging the actuator assembly; and (c) an expanding resistant reservoir in fluid communication with the piston housing.

2. The system of claim 1, the system further comprising a container sealably connected to the collar cap.

3. The system of claim 2, wherein the inlet comprises a port.

4. The system of claim 3, wherein the port may be sealably connected to an upper end of a dip tube, the dip tube further comprising a lower end such that when the dip tube is extended downwardly into the container, the lower end of the dip tube is in fluid communication with the product.

5. The system of claim 2, wherein the piston collar is essentially circular and comprises an exterior wall and an interior wall, the interior wall further comprising a set of grooves.

6. The system of claim 5, wherein the linear travel of the spindle within the piston collar is by way of an interaction between the set of threads of the spindle and the set of grooves of the piston collar.

7. The system of claim 6, wherein the actuator housing and the collar cap are both substantially circular, and further wherein the actuator housing and the collar cap are connected in a manner such that each is able to rotate in both a clockwise and a counterclockwise direction around a common axis.

8. The system of claim 7, wherein the linear travel of the spindle is initiated by a rotation of the actuator housing in one direction simultaneous to either a rotation of the collar cap in a reverse direction, or of a counter force applied either the collar cap or the container, wherein the counter force is sufficient to restrict a rotation of the collar cap or the container.

9. The system of claim 8, wherein a first rotation of the actuator housing and either a first simultaneous rotation of the collar cap or an application of the counter force to either the collar cap or the container forces the piston and the spindle to travel linearly upwardly through the piston housing, thus hydraulically drawing product into the piston housing.

10. The system of claim 9, wherein a second rotation of the actuator housing and either a second simultaneous rotation of the collar cap or an application of the counter force to either the collar cap or the container forces the piston and the spindle to travel linearly downwardly through the piston housing, thus hydraulically forcing product into the reservoir.

11. The system of claim 10, wherein the actuator housing is further defined by having an exterior surface and the collar cap is further defined by having an exterior surface, and the exterior surface of each further comprise a surface variation to enhance gripability in order to facilitate rotation.

12. The system of claim 10, wherein the spindle is further defined by a specific pitch of each of the set of threads and by a specific distance between each of the set of threads.

13. The system of claim 12, wherein the specific pitch of each of the set of spindle's threads and the specific distance between each of the set of the spindle's threads can both be varied to change the amount of product drawn into the piston housing and forced into the reservoir.

14. The system of claim 7, wherein the actuator housing has an inner wall, and outer wall and an intermediate wall disposed between the inner and outer walls.

15. The system of claim 14, wherein the intermediate wall of the actuator housing further comprises a set of grooves to allow for additional linear travel of the piston when combined with the set of threads of the spindle.

16. The system of claim 1, wherein the outlet for dispensing the product comprises an orifice.

17. The system of claim 1, wherein the valve further comprises a valve stem seal and a spring valve retainer, the valve stem seal seated within the actuator and further capable of connectably engaging the spring valve retainer.

18. The system of claim 1, wherein the piston housing is sealably connected to the reservoir.

19. The system of claim 1, wherein the system further comprises at least one vent that allows the system to restore equilibrium following the dispensing of the product by facilitating an inflow of ambient air into the system.

20. The system of claim 19, wherein the set of grooves on the interior wall of the piston collar is further defined by each groove having a pitch, and is also further defined by having a distance between each of the set of grooves, wherein the pitch of, and the distance between each of the set of grooves can be varied to change the amount of product drawn into the piston housing and forced into the reservoir.

21. The system of claim 1, wherein the reservoir comprises an elastomeric bladder.

22. The system of claim 21, wherein the system further comprises an overcap, and wherein the overcap, the valve stem seal, the spring valve retainer, the actuator housing, the collar cap, the piston collar, the spindle, the piston, the piston housing and the container are substantially symmetrically disposed about a common axis.

23. The system of claim 21, wherein the elastomeric bladder is further defined by a material, a volume, and a geometrical shape.

24. The system of claim 23, wherein the material, the volume and/or the geometrical shape of the elastomeric bladder can be varied to change the amount of product dispensed.

25. The system of claim 1, wherein the activating mechanism comprises an activation button, which when depressed, triggers a release of the product through the outlet of the actuator assembly.

26. The system of claim 1, wherein the piston is further defined by a diameter and a length, and wherein the diameter and the length of the piston can be varied to change the amount of product drawn into the piston housing and forced into the reservoir.

27. The system of claim 1, wherein the piston and the spindle are sealably combined to form a first single component.

28. The system of claim 27, wherein the piston collar and the collar cap are sealably combined to form a second single component.

29. The system of claim 1, wherein the piston housing is sealably connected to the piston collar.

30. A mechanically pressurized system for dispensing product, comprising:

(a) an actuator assembly, the actuator assembly comprising:

(i) an actuator, the actuator further comprises an outlet orifice and an activating mechanism for triggering a dispensing of the product through said outlet orifice;

(ii) a valve, the valve further comprises a valve stem seal and a spring valve retainer, wherein the valve stem seal seats within the actuator and wherein the valve stem seal is further connectably engaged with the spring valve retainer, the valve further having a first position where, once engaged, the product is unable to flow to the outlet orifice, and a second position where, once engaged, the product is able to flow to the outlet orifice, and wherein the valve is in communication with the activating mechanism such that when the activating mechanism is triggered, the second position of the valving means is selected and the product is able to flow to the outlet orifice; and (iii) an actuator housing, the actuator housing being substantially circular and further comprising at least an substantially circular inner wall and a substantially circular outer wall, wherein the inner wall defines an annular space capable of accepting the spring valve retainer;

(b) a piston assembly, the piston assembly comprising:

(i) a piston, the piston further defined as having a length and a diameter, and wherein the piston is in combination with a spindle, the spindle having an inner wall and an outer wall, the outer wall further comprising a set of threads;

(ii) a piston housing, the piston housing having a diameter at least slightly larger than the diameter of the piston such that the piston housing can accommodate the piston in combination with the spindle, the piston housing further comprising an inlet orifice;

(iii) a substantially circular piston collar, the piston collar further comprising an outer wall and an inner wall, the inner wall further comprising a set of grooves, wherein the set of grooves of the piston collar engage the set of threads of the spindle to generate linear travel of the spindle within the piston collar; and (iv) a collar cap, the collar cap being substantially circular and further comprising at least a substantially circular inner wall and a substantially circular outer wall, the inner wall further comprising a set of grooves, the collar cap further being capable of connectably engaging the piston collar and also further being capable of connectably engaging the piston housing, and wherein the collar cap is further capable of connectably engaging the actuator housing; and (c) an expanding resistant reservoir in fluid communication with the piston housing.

31. The system of claim 30, wherein the system further comprises a container, the container further comprising a set of threads so that the set of threads of the container and the set of grooves of the collar cap engage to create a sealable connection.

32. The system of claim 31, wherein the system further comprises an overcap, the overcap sealably connected to the actuator housing, and wherein the overcap, the actuator, the valve, the actuator housing, the piston, the spindle, the piston housing, the piston collar, the collar cap, the reservoir and the container are substantially symmetrically disposed about a common axis.

33. The system of claim 32, wherein the actuator housing and the collar cap are connected in a manner such that each is able to rotate in both a clockwise and a counterclockwise direction around a common axis.

34. The system of claim 33, wherein when a first rotational force is applied to the actuator housing, and a first counter-directional rotational force is applied to either the collar cap or to the container, the set of threads of the spindle travels linearly along the set of grooves of the piston collar forcing the piston to travel linearly upwardly through the piston housing, thus hydraulically drawing product into the piston housing.

35. The system of claim 34, wherein when a second rotational force is applied to the actuator housing in an opposite direction of the first rotational force, and a second counter-directional force is applied to either the collar cap or to the container, the set of threads of the spindle travels linearly along the set of grooves of the piston collar forcing the piston to travel linearly downwardly through the piston housing, thus hydraulically forcing product into the reservoir.

36. The system of claim 35, wherein the outer wall of the actuator housing and the outer wall of the collar cap each further comprise a surface variation to enhance gripping.

37. The system of claim 36, wherein the set of threads of the spindle and the set of grooves of the collar cap are each further defined by a specific pitch of each thread or groove and by a specific distance between each thread or groove, and wherein each specific pitch and/or each specific distance of either the set of threads of the spindle or the set of grooves of the piston collar can be varied to change the amount of linear travel generated by the first and second rotational forces applied to the actuator housing and either the collar cap or the container.

38. The system of claim 30, wherein the inlet orifice of the piston housing is sealably connected to an upper end of a dip tube, the dip tube further having a lower end, the dip tube extending downwardly into the container such that the lower end is in fluid communication with the product.

39. The system of claim 30, wherein the length of the piston or the diameter of the bore of the piston can be varied to change the amount of product drawn into the piston housing and forced into the reservoir.

40. The system of claim 30, wherein the reservoir is an elastomeric bladder, the elastomeric bladder is further defined by a material, a volume, and a geometrical shape, and wherein the material, the volume, and/or the geometrical shape of the elastomeric bladder can be varied to change the amount of product dispensed.

41. The system of claim 30, wherein the actuator housing has an substantially circular intermediate wall disposed between the inner and the outer wall, and wherein the intermediate wall further comprises a set of interior grooves to allow for additional linear travel of the spindle past the set of grooves of the piston collar.

42. The system of claim 30, wherein the piston and the spindle are combined to form a first single component.

43. The system of claim 42, wherein the piston collar and the collar cap are combined to form a second single component.

44. A pressurization assembly of a mechanically pressurized dispensing system, comprising:

a first assembly, comprising:

a cap;

a housing configured proximate said cap;

a piston configured with said housing;

a spindle configured to engage said piston and having a plurality of threads; and a collar having a plurality of grooves, wherein said threads of said spindle are configured to engage said grooves of said collar to provide linear travel of said piston within said housing upon rotation of said spindle relative to said collar; and a second assembly, comprising:

an actuator engaged with said first assembly;

wherein said threads of said spindle and said threads of said collar define a first helix and wherein said first assembly further comprises a plurality of threads defining a second helix, said first helix and said second helix defining a double helical configuration.

45. A pressurization assembly as described in claim 44, wherein said treads of said wall are configured to engage said first assembly.

46. A pressurization assembly as described in claim 44, wherein wherein said linear travel of said piston corresponds to said double helical configuration.

47. A pressurization assembly as described in claim 46, wherein said piston is configured for liner travel within said housing upon a rotation of said actuator relative to said first assembly.

48. A pressurization assembly as described in claim 47, wherein said piston is configured for linear travel upon a rotation of said spindle relative to said collar.

49. A mechanically pressurized dispensing system, comprising:

a housing;

a piston configured with said housing;

a spindle configured to engage said piston and having a plurality of threads;

a collar having a plurality of grooves, wherein said threads of said spindle are configured to engage said grooves of said collar to provide linear travel of said piston within said housing upon rotation of said spindle relative to said collar; and a plurality of threads configured with said housing;

wherein said threads of said spindle and said threads of said collar define a first helix and wherein said threads of said wall define a second helix, said first helix and said second helix defining a double helical configuration.

50. A mechanically pressurized dispensing system as described in claim 49, wherein wherein said linear travel of said piston corresponds to to said double helical configuration.

51. A mechanically pressurized dispensing system as described in claim 50, further comprising an actuator and wherein said piston is configured for linear travel within said housing upon a rotation of said actuator.

52. A mechanically pressurized dispensing system as described in claim 51, wherein said piston is configured for linear travel upon a rotation of said spindle relative to said collar.

* * * * *